US009777570B2

(12) United States Patent
Braisher et al.

(10) Patent No.: US 9,777,570 B2
(45) Date of Patent: Oct. 3, 2017

(54) AT-BIT DOWNHOLE SENSOR AND TRANSMITTER

(71) Applicant: PULSE DIRECTIONAL TECHNOLOGIES, INC., Calgary (CA)

(72) Inventors: Steve Braisher, Okotoks (CA); Karl Edler, Calgary (CA); Martin Kanka, Calgary (CA)

(73) Assignee: Pulse Directional Technologies, Inc., Calgary (CA)

( * ) Notice: Subject to any disclaimer, the term of this patent is extended or adjusted under 35 U.S.C. 154(b) by 50 days.

(21) Appl. No.: 15/009,095

(22) Filed: Jan. 28, 2016

(65) Prior Publication Data

US 2016/0230546 A1 Aug. 11, 2016

Related U.S. Application Data

(60) Provisional application No. 62/114,437, filed on Feb. 10, 2015.

(51) Int. Cl.

| | |
|---|---|
| ***E21B 47/18*** | (2012.01) |
| ***E21B 47/10*** | (2012.01) |
| ***E21B 47/12*** | (2012.01) |

(52) U.S. Cl.
CPC ..... *E21B 47/18* (2013.01); *E21B 47/101* (2013.01); *E21B 47/122* (2013.01)

(58) Field of Classification Search
CPC ..... E21B 47/18; E21B 47/122; E21B 47/101
USPC ..... 367/83
See application file for complete search history.

(56) References Cited

U.S. PATENT DOCUMENTS

2004/0206510 A1* 10/2004 Fraser ..... E21B 17/028 166/378
2013/0043874 A1* 2/2013 Clark ..... E21B 10/00 324/369

* cited by examiner

*Primary Examiner* — Tanmay Shah
(74) *Attorney, Agent, or Firm* — McAfee & Taft

(57) ABSTRACT

A system and method of transmitting measurement-while-drilling (MWD) data while drilling a wellbore in a subterranean formation are provided. The system utilizes a transmission sub located uphole of the drill bit which transmits an electromagnetic signal through the surrounding drilling fluid to a receiver assembly located farther uphole at a position suitable for relaying the signal to the surface.

19 Claims, 8 Drawing Sheets

AT-BIT DOWNHOLE SENSOR AND TRANSMITTER

CROSS REFERENCE TO RELATED APPLICATION

This application claims the benefit of U.S. Provisional Application 62/114,437 filed on Feb. 10, 2015, which is incorporated by reference.

FIELD

This disclosure relates generally to the drilling of wells and to sensors that provide measurements obtained during the drilling of wells. More particularly, this disclosure relates to sending signals containing such measurements to the surface.

BACKGROUND

Oil and gas wells (wellbores) are usually drilled with a drill string that includes a tubular member having a drilling assembly (also referred to as the bottom hole assembly or "BHA") with a drill bit attached to the bottom end thereof. The drill bit is rotated to disintegrate the earth formations thus drilling the wellbore. The BHA includes devices and sensors for providing information about a variety of parameters relating to the drilling operations, behavior of the BHA and formation surrounding the wellbore being drilled (formation parameters). A variety of sensors, including radiation detectors, generally referred to as logging-while-drilling (LWD) sensors or measurements-while-drilling (MWD) sensors, are disposed in the BHA for estimating properties of the formation. Radiation sensors, whether for detecting gamma rays naturally occurring in the earth (passive measurement) or radiation emitted in the formation in response to induced radiation from a radiation source ("active measurement"), are placed in the BHA. Such sensors are close to the formation and may provide high resolution results relating to distinguishing rock formations when the drill bit moves from one type of formation to another, such as from shale to sand or vice versa. However, these sensors are placed far from the bit above the mud motor and thus they cannot provide information relating to the formation near or at the drill bit.

Therefore, there is a need for systems that allow for placing sensors close to the drill bit for improved estimations of formation properties during drilling of a wellbore.

SUMMARY

In some aspects, the present disclosure provides for a method of transmitting measurement-while-drilling (MWD) data while drilling a wellbore in a subterranean formation. The method comprises the steps of:

- forming the wellbore with a drill string ending in a drill bit, said drill string further comprising a transmission sub located uphole of the drill bit, a mud motor located uphole of the data transmission sub and a receiver assembly located uphole of the mud motor and wherein the transmission sub has a first gap at an uphole end of the transmission sub, and the receiver assembly has a second gap;
- taking one or more measurements by a sensor contained in the transmission sub; and
- transmitting the measurements from the transmission sub to the receiver assembly by the transmission sub generating an electromagnetic signal across the first gap and the receiver assembly detecting the signal by measuring voltage across the second gap.

In some aspects, the method further comprises transmitting the signal from the receiver assembly to the surface by generating a mud pulse in a first drilling fluid located within the drill string. Additionally, the step of generating the signal across the first gap can comprise placing a voltage difference across the first gap, generating a signal having a frequency below about 1 kHz (optionally, from about 5 Hz to about 100 Hz or from about 6 Hz to about 20 Hz in the transmission sub, and transmitting the signal through a second drilling fluid and formation located outside the drill string to the mud motor. Further, the signal travels through the second drilling fluid and the formation, and the signal can be detected by the receiver assembly measuring the voltage across the second gap.

In other aspects, the present disclosure provides for a drill-string system for transmitting measurement-while-drilling (MWD) data while drilling a wellbore in a subterranean formation. The drill-string system comprises a drill bit, a transmission sub, a mud motor, and a receiver assembly.

The transmission sub has a downhole end, an uphole end and a first gap at the uphole end. Further, the transmission sub has a power source, a sensor and an electromagnetic transmitter. The transmission sub is located uphole of the drill bit. The mud motor is located uphole of the transmission sub.

The receiver assembly has a downhole end, an uphole end and a second gap. Further, the receiver assembly has an electromagnetic receiver attached across the second gap, and the electromagnetic receiver is powered by a power source. The receiver assembly is located uphole of the mud motor.

The sensor measures at least one parameter of the drilling operation to obtain drilling data close to the bit. The transmitter sends an electromagnetic signal representing the drilling data to the receiver by the transmission sub generating an electromagnetic signal across the first gap and the electromagnetic receiver detecting the signal by measuring voltage across the second gap.

In some embodiments, the drill-string system further comprises a pulser which is configured to generate a mud pulse such that the electromagnetic signal is converted to a mud pulse signal to transmit the drilling data to the surface. Also, the drill-string system can further comprise a drill string uphole from the receiver assembly. The drill string can have a central bore suitable for conveying drilling fluid downhole. The pulser can generate the mud pulse in the drilling fluid within the central bore.

In some embodiments, the transmitter is configured to place a voltage difference across the first gap and to generate a signal having a frequency that is transmitted through a drilling fluid and/or the surrounding formation to a portion of the drill string uphole from the first gap and downhole from the second gap. The drilling fluid, which transmits the signal, can be located outside the drill string and can surround at least the transmission sub and the portion of the drill string extending to the uphole end of the receiver assembly. The portion of the drill string can include the mud motor.

Additionally, the electromagnetic signal can have a frequency below about 1 kHz, from about 5 Hz to about 100 Hz or from about 6 Hz to about 20 Hz. Also, the sensor can be an inclination sensor, a gamma sensor and/or a resistivity sensor.

Other aspects and embodiments will become apparent from the detailed description below.

DETAILED DESCRIPTION

Figure 1:
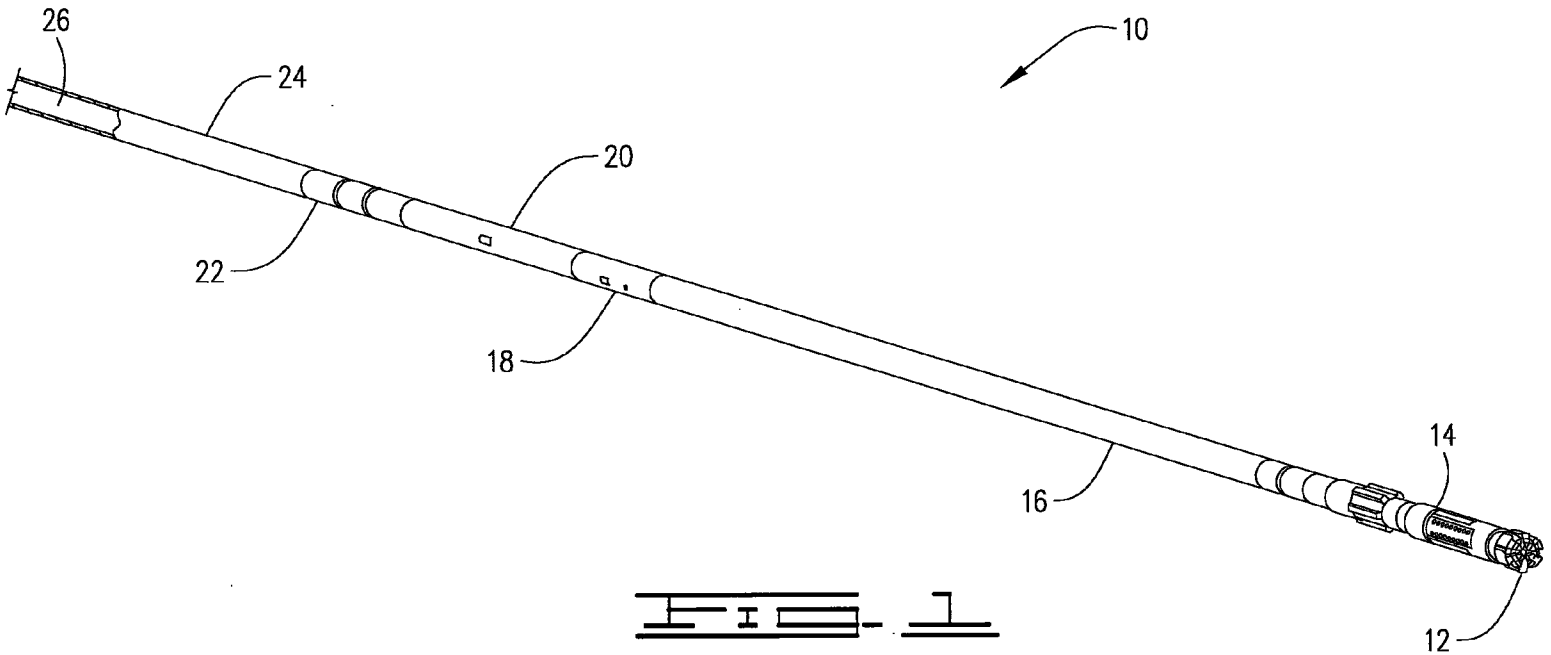
FIG. 1 is a schematic illustration of a bottom hole assembly incorporating the current transmitter and receiver system.

Referring now to the drawings, wherein like reference numbers are used herein to designate like elements throughout the various views, various embodiments are illustrated and described. The figures are not necessarily drawn to scale, and in some instances the drawings have been exaggerated and/or simplified in places for illustrative purposes only. In the following description, the terms "upper," "upward," "uphole", "lower," "below," "downhole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Turning now to FIG. 1, a bottom-hole assembly 10 is illustrated. Bottom-hole assembly 10 has a drill bit 12, a transmission sub 14, mud motor 16, a universal bottom hole orienting (UBHO) sub 18, a pony sub 20, receiver assembly 22 and drill collar 24. Bottom-hole assembly 10 is part of the drill string for drilling a well. Typically, drill bit 12 is in the lowest position downhole so that that it can cut through the subterranean formations, and thus, form the wellbore.

Uphole from the drill bit 12 is transmission sub 14. To provide the advantage of obtaining measurements at the drill bit 12, the transmission sub can be located immediately uphole from drill bit 12. "Immediately" as used herein means without any intervening drill-string components. Typically, transmission sub 14 will be located within 7 feet of the downhole end of drill bit 12 and, more typically, within 5 feet or 4 feet. Transmission sub 14 is located close to drill bit 12 so that it can obtain real-time information on the drilling. Generally, transmission sub 14 can obtain certain MWD information such as gamma radiation, inclination, density, porosity, resistivity, vibration, shock, temperature, acceleration, etc. Typically, transmission sub 14 obtains measurements on the natural gamma ray emissions from rock to help determine what type of rock formation is being drilled, which in turn helps confirm the real-time location of the wellbore in relation to the presence of different types of known formations. Additionally or alternatively, transmission sub 14 can obtain inclination measurements; that is, measurements of the wellbore inclination from vertical and also magnetic direction from the north so that a three-dimensional plot of the path of the well can be produced. Also, transmission sub 14 can be configured to obtain resistivity measurements from the surrounding formation. Further, the transmission sub can obtain measurements related to the system performance such as battery voltage and transmission power lever.

Figure 6:
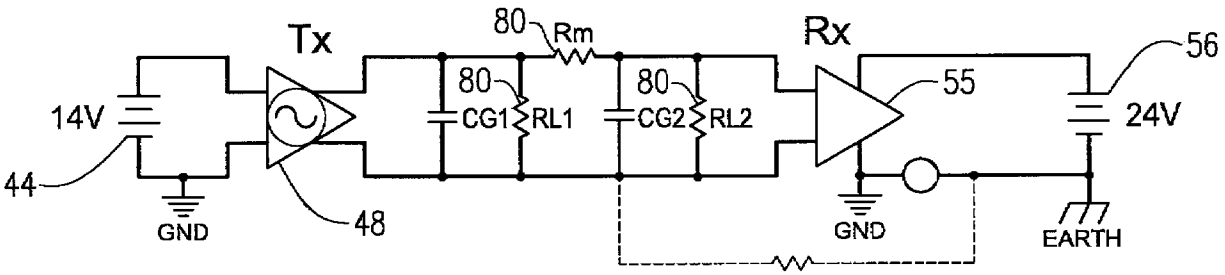
FIGS. 6A and 6B illustrates an embodiment of the transmitter that uses a pair of coils on the transmission sub to obtain resistivity measurements.

With reference to FIGS. 6A and 6B, a system and method for obtaining resistivity measurements, which can be used in the current transmission sub 14, is explained. An upper coil 90 is placed under ceramic ring 92, which is part of the insulating gap 38 on uphole end 34 of transmission sub 14. Upper coil 90 is periodically driven by a corresponding power amplifier at a frequency that can be on the order of $10^2$ Hz to $10^6$ Hz, for example, the frequency could be near either 400 kHz or 2 MHz. The EM signal generated by upper coil 90 propagates into the surrounding geologic formations and is detected by a second coil or lower coil 94 and associated electronics on the downhole end 32 of the transmission sub 14. Lower coil 94 is located beneath a metal grating 96. The magnitude ratio of the current in upper coil 90 to the detected voltage in lower coil 94 can be used to determine the resistivity of the surrounding geologic formation at a certain depth. Likewise, the difference in the phase between the current in upper coil 90 and the detected voltage in lower coil 94 can also be used to determine the formation resistivity but at a shallower depth. These measurements will typically be calibrated with respect to temperature which is accomplished with the aid of a precise temperature gauge within the transmission sub. Moreover, information about the formation's dielectric constant can be obtained from examination of both the magnitude ratio and phase shift.

Gravitational field measurements and magnetic field measurements may be taken while the transmitter sub is motionless. However, in some embodiments these measurements can be taken while the transmitter sub is in motion, that is, during drilling. Algorithms can be used to determine the direction of the earth's magnetic field and gravitational field at any instant during drilling despite the magnetic fields associated with the drill bit and mud motor (magnetic offset), and despite shocks and spinning at up to 240 RPM.

Using the magnetic field and acceleration measurements while drilling/rotating, the transmission sub is able to determine the inclination, azimuth, and RPM while rotating. This is accomplished by filtering out drilling vibrations from the acceleration data and subtracting a local magnetic offset from the magnetic field data.

Even though gamma measurements can be directionally sensitive, only gamma counts while drilling generally can be measured because of problems determining orientation. As indicated above, using the magnetic field and acceleration measurements, the orientation can be determined during drilling. Since the orientation of the transmission sub can be known while rotating, gamma counts and resistivity can be correlated to the direction in the borehole, either Up-Right-Down-Left or North-East-South-West depending on an inclination threshold. More graduations of direction are also possible, limited only by the rate at which measurements are made and the desired sampling period. In this way, the direction the gamma counts are coming from can be determined by using the current transmission sub; thus, a better understanding of how the types of rock are distributed around the borehole can be achieved.

Returning now to FIG. 1, uphole from transmitter 14 is mud motor 16, which uses hydraulic power of the drilling fluid or drilling mud to drive the drill bit. Uphole from mud motor 16 can be UBHO sub 18 and pony sub 20, as needed, and is receiver assembly 22. Receiver assembly 22 comprises a gap sub, which is an outer collar, and an electromagnetic receiver contained within gap sub, as further described in relation to FIG. 3 below. The electromagnetic receiver receives electromagnetic signals from transmission sub 14 and relays them uphole to the surface. In one embodiment, the signal can be relayed as a mud pulse, as further described below. Additionally, between receiver assembly 22 and transmission sub 48 there can be one or more drill collars (not shown).

Drill collar 24 is uphole from receiver assembly 22 and serves as part of the drill string having a central bore 26 through which drilling fluid is flowed. Generally, drill collars are thick-walled tubular pieces machined from solid bars of steel, usually plain carbon steel but sometimes of nonmagnetic nickel-copper alloy or other nonmagnetic premium alloys. The bars of steel have a central bore running through them end to end to provide a passage to pumping drilling fluids or drilling mud through the collars. Gravity acts on the large mass of the collars to provide the downward force needed for the bits to efficiently break rock.

Figure 2:
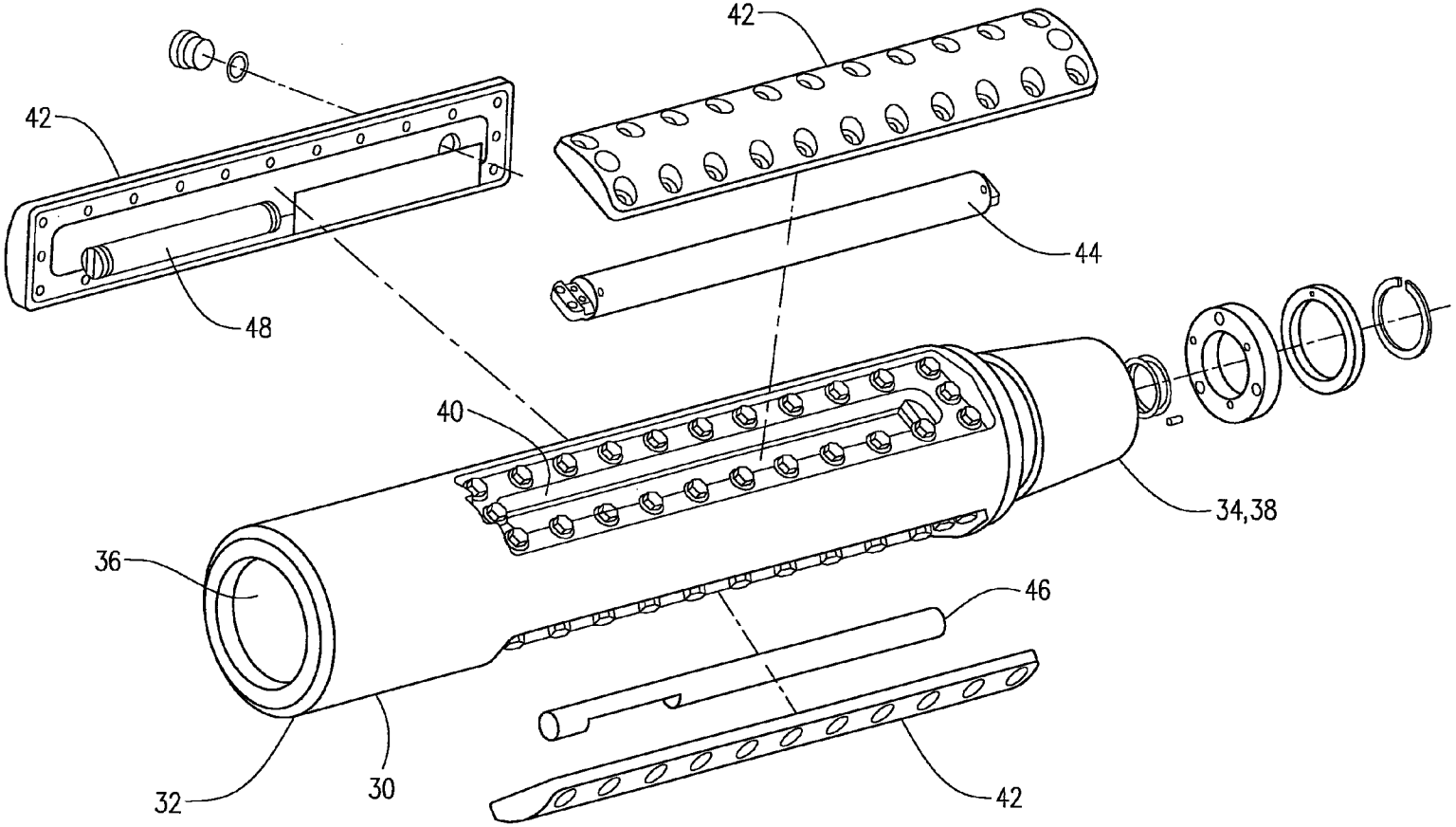
FIG. 2 is a schematic illustration of a transmission sub in accordance with one embodiment.

Turning now to FIG. 2, transmission sub 14 will now be further described. Transmission sub 14 comprises a tubular body 30 having downhole end 32, uphole end 34 and a central bore 36. Central bore 36 is in fluid flow communication with the mud motor 16 so as to allow the flow of drilling fluid from mud motor 16 to drill bit 12.

Transmission sub 14 terminates at uphole end 34 in a gap 38. A gap is a device that will block current flow through the conductive steel pipe of the drill string. Thus, gap 38 blocks current flow from transmission sub 14 to the components of the drill-string assembly uphole from transmission sub 14. Any suitable gap can be used; one design is disclosed in U.S. Pat. No. 7,255,183.

The tubular body 30 has a plurality of recessed chambers 40. A plate 42 can cover each recessed chamber 40. As illustrated, each of the three recessed chambers 40 house an element of the transmission sub. One of the recessed chambers houses a battery 44 to power transmission sub 14. A second of the recessed chambers houses a sensor 46, which can be any suitable sensor 46 for making MWD measurements, such as a gamma sensor, an inclinator sensor and/or a resistivity sensor. A third of the recessed chambers contains the electromagnetic transmitter 48, which can include an analog-to-digital converter, micro control unit, micro drive and similar for recording data from the sensor and converting it into an electromagnetic signal.

It will be apparent to those skilled in the art based on this disclosure, that the chambers can hold either a single element or multiple elements. The location of the elements of the transmission sub within the plurality of chambers will depend on the size of each element and the measurement needs. For example, in one embodiment, one chamber houses battery 44, another chamber houses gamma sensor 46, and the third chamber houses the following: the transmitter 48, a micro-computer, a power regulation unit, three orthogonal magnetic sensors, three orthogonal acceleration sensors used to determine inclination, two orthogonal acceleration sensors used to determine vibration, a temperature sensor, a resistivity sensor, flash memory, and a programming communication port. In another embodiment, one chamber houses a first battery, a second chamber houses a second battery and the third chamber houses transmitter 48, a micro-computer, a power regulation unit, three orthogonal magnetic sensors, three orthogonal acceleration sensors used to determine inclination, two orthogonal acceleration sensors used to determine vibration, a temperature sensor, a resistivity sensor, flash memory, and a programming communication port.

Generally, when the transmission sub is on the surface before or after a drilling run, it can be programmed or have its memory read through a programming communication port. In some embodiments, when the transmission sub is on the surface before or after a drilling run, it can be programmed or have its member read through the insulating gap 38 on the transmission sub 14 without use of a programming port.

Figure 3:
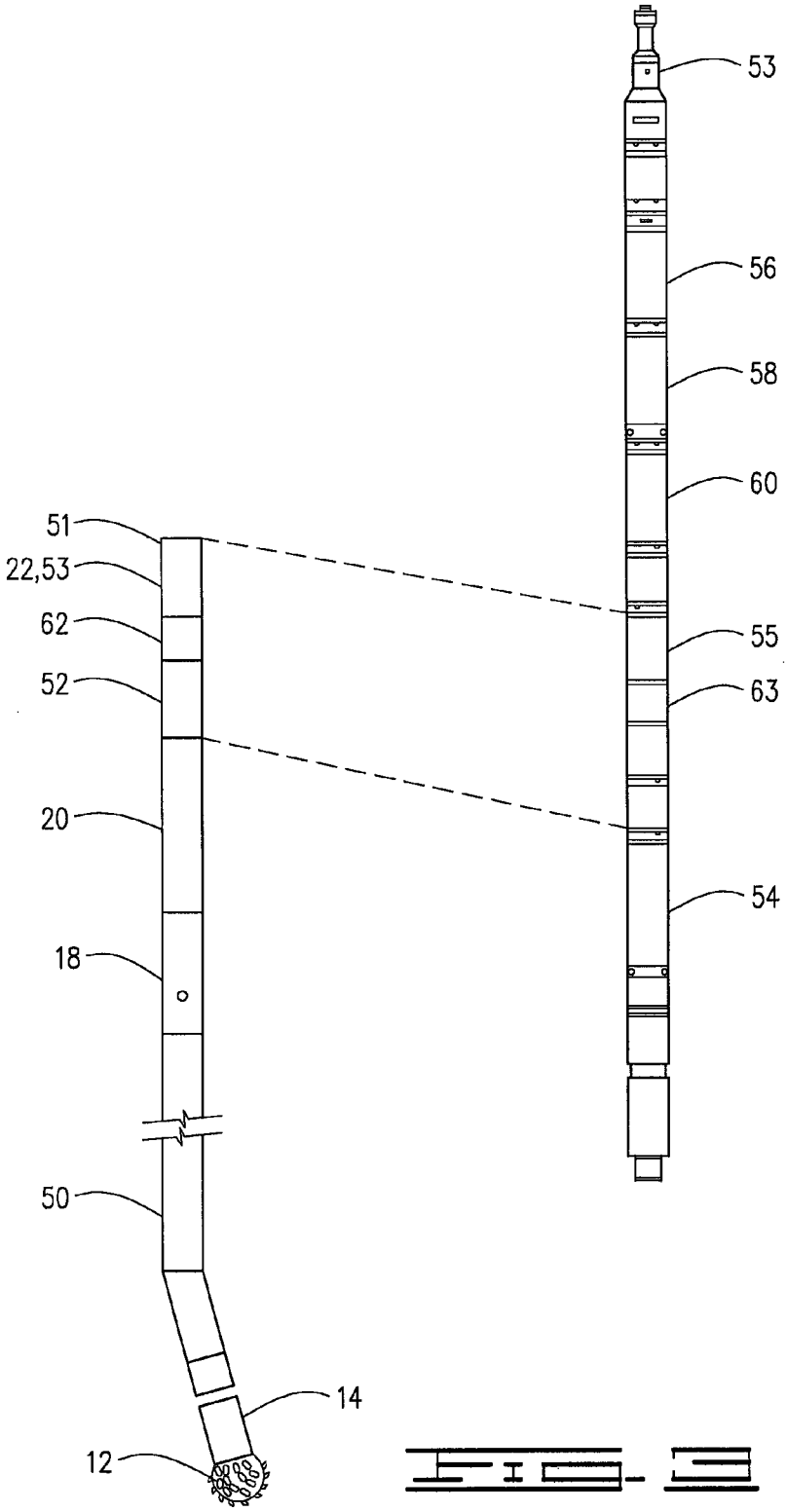
FIG. 3 is an illustration illustrating the components of the current drill-string system and the location of a receiver assembly in accordance with an embodiment.

The orientation and location of the receiver assembly 22 can be seen with reference to FIG. 3, wherein outer components are shown in the left portion of FIG. 3 and inner components are shown in the right portion of FIG. 3. Receiver assembly 22 is shown in reference to its orientation and placement in drill string 50. Receiver assembly 22 has an uphole end 51 and a downhole end 52. Receiver assembly comprises gap sub 53, which generally is a tubular collar like sub having a central bore 26 through which drilling fluid can flow. Gap sub 53 includes gap 62, which electromagnetically isolates the portions of the drill string on either side of it.

Contained within gap sub 53 is an electromagnetic receiver 55. Electromagnetic receiver 55 is in communication with a pulser 54 located within pony sub 20. Electromagnetic receiver 55 can be in communication with directional unit 58, which can serve as the central processor for all the items in the upper tool-string. Directional unit 58 can receive data from a gamma sensor 60, as well as other components of the upper tool-string, and can communicate to the surface by sending signals through pulser 54. In some embodiments, receiver 55 can be in communication with a gamma sensor 60 and directional unit 58; however, more typically, receiver 55 will only be in communication with directional unit 58. Receiver 55, directional unit 58, and other components of the upper tool-string can be powered by a battery 56. Gamma sensor 60, directional unit 58 and battery 56 can be contained within the drill collar 24 immediately uphole from receiver assembly 22.

Typically, battery 56 provides power for receiver 55. Receiver 55 receives an electromagnetic signal from transmission sub 14 and in conjunction with directional unit 58 and pulser 54 generates mud pulses, which convey the data contained in the electromagnetic signal to the surface. The receiver 55 includes a gap 63 that works in conjunction with gap 62 of gap sub 53 to block the current flow to receiver 55 from downhole. In some embodiments, receiver 55 can send messages directly to pulser 54 without relaying them through the directional unit 58.

Figure 4:
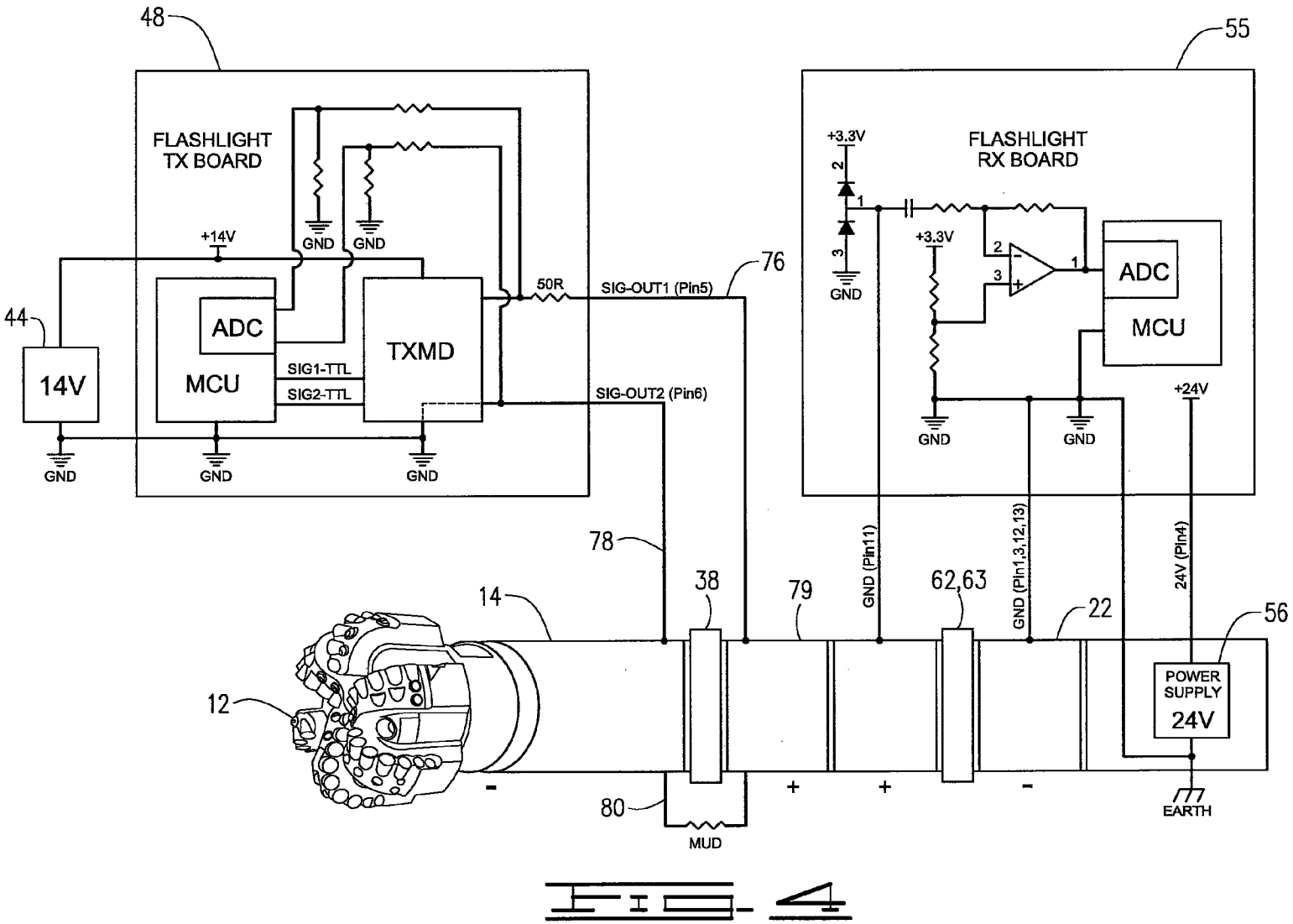
FIG. 4 is a block diagram illustrating a simplified electrical design of the transmission sub and receiver assembly and their interaction.

Turning now to FIG. 4, the operation of transmission sub 14 and receiver 55 will be further explained. Generally, a wellbore is formed by the drill-string assembly illustrated in FIG. 1. As the drill bit drills out subterranean material from the formations it passes through, the sensor (not shown in FIG. 4) in the transmitting sub 14 takes one or more measurements of at least one parameter of the drilling operation to thus produce drilling data. The drilling data can be recorded to a flash drive or other memory device contained in transmission sub 14 and can be converted to an electromagnetic signal by micro control unit and transmitter circuitry. Transmitter 14 then sends the electromagnetic signal to receiver 55 contained in receiver assembly 22, as illustrated in FIG. 4.

Figure 5:
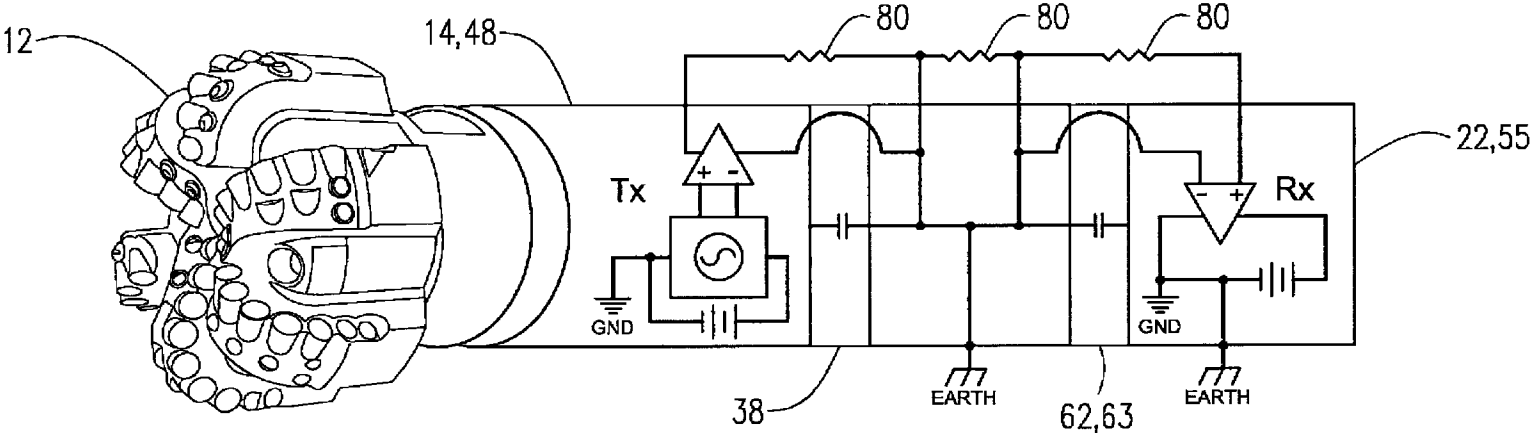
FIG. 5A is another block diagram further illustrating a simplified electrical design of the transmission sub and receiver assembly and their interaction.
FIG. 5B illustrates the transmitter/receiver system as a single circuit with RL1, RL2 and Rm modeling the mud and formation. Additionally, CG1 and CG2 model the capacitances of the gaps.
FIG. 5C illustrates an embodiment of the transmitter that uses a plurality of electrodes on the transmission sub to obtain resistivity measurements.

As shown in FIG. 4, the transmitter 48 puts out a voltage differential (illustrated as 14V) between a first output 76 and a second output 78 and, hence, across gap 38 at the uphole end 34 of transmission sub 14. Because gap 38 prevents electrical current crossing between transmission sub 14 and drill-string portion 79, the current flows through the drilling fluid surrounding the drill string and can flow through the surrounding subterranean formation. The surrounding drilling fluid and formation are illustrated by resistor 80 in FIG. 4 and are herein referred to as the surrounding environment 80. (In FIG. 5B, the surrounding environment is more clearly illustrated by three resistors 80: RL1, RL2 and Rm. The surrounding environment 80 is the drilling fluid surrounding the drill string from at least the transmission sub 14 to receiver assembly 22 and can include the formation surrounding the borehole in this area. The surrounding environment 80 around the bottom hole assembly acts to transmit the voltage across gap 38 to drill-string portion 79. Drill string portion 79 is the portion of the drill string between gap 38 and gaps 62 and 63. Drill string portion 79 can include mud motor 16, UBHO sub 18, pony sub 20 and one or more drill collars but, typically, would not include any gaps or other drill-string segments that would block current flow through the drill-string portion.

In one embodiment, the transmitted voltage is modulated at one or more frequencies. For example, the transmitted voltage can be modulated at four different frequencies and the resulting current flows through the mud in the form of an electromagnetic signal. Most of the power of this electromagnetic signal is dissipated close to gap 38 but some small current flows through the mud and formation from the transmission sub 14 and/or drill bit 12 around to the receiver 55 and back to the portion of the drill string just downhole of gap 62, 63 of gap sub 53. The voltage across gap 62, 63 produced by this small current is picked up by the receiver 55 so that the electromagnetic signal is thus transmitted to receiver 55. The signal is amplified, filtered, and analyzed by receiver 55 to determine what data has been collected from sensor 46.

Figure 5C:
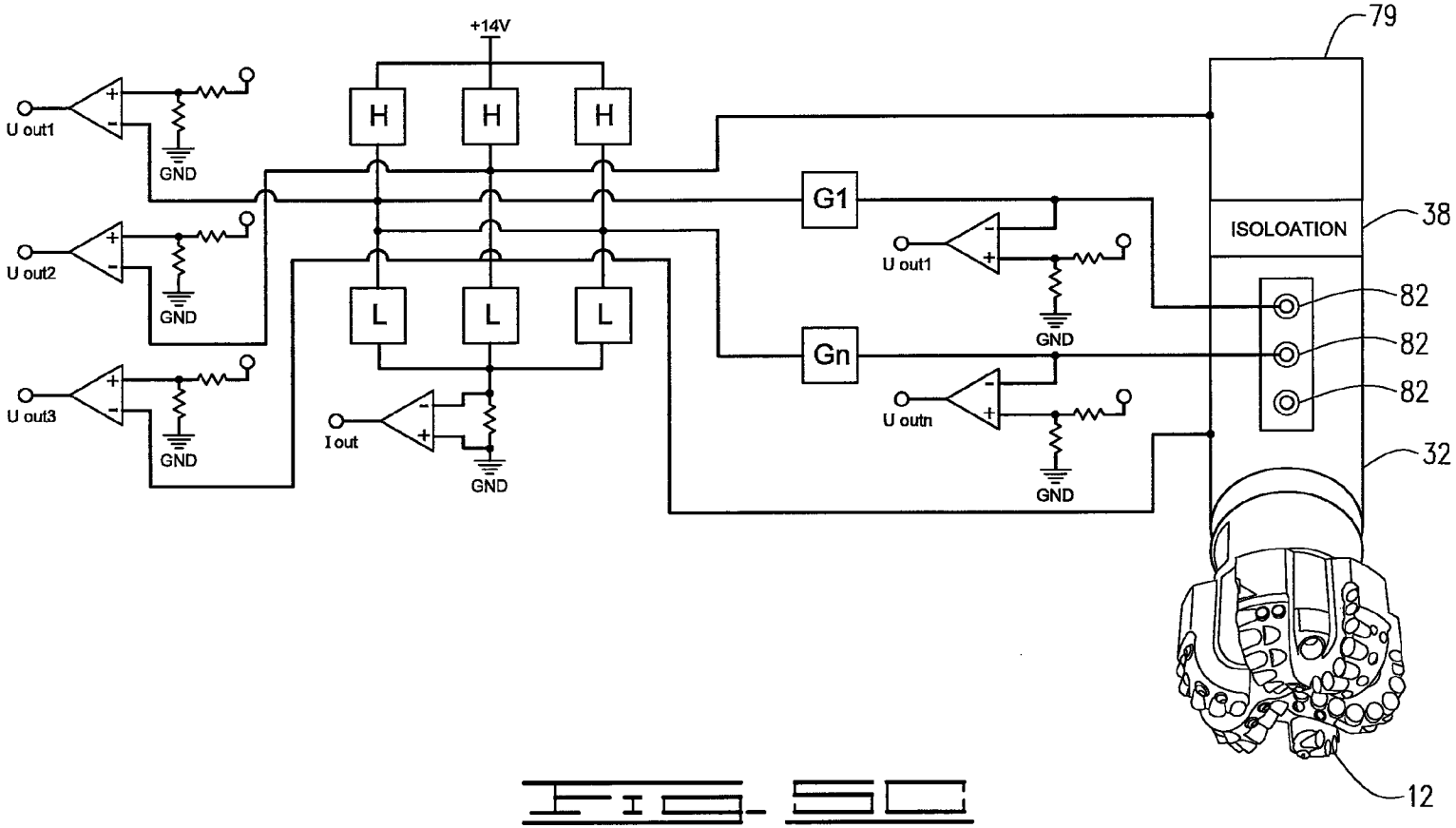
Figure 5A:
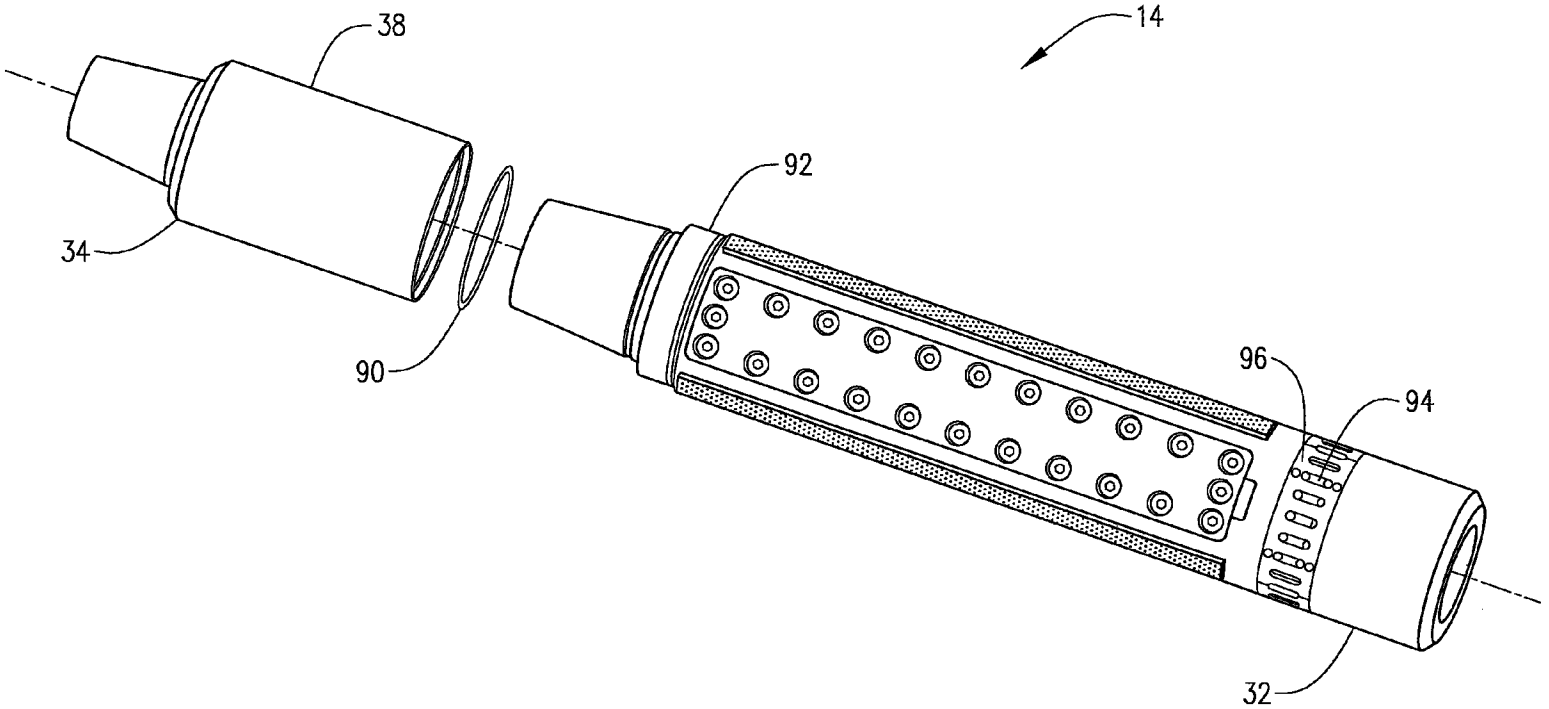
Figure 5:
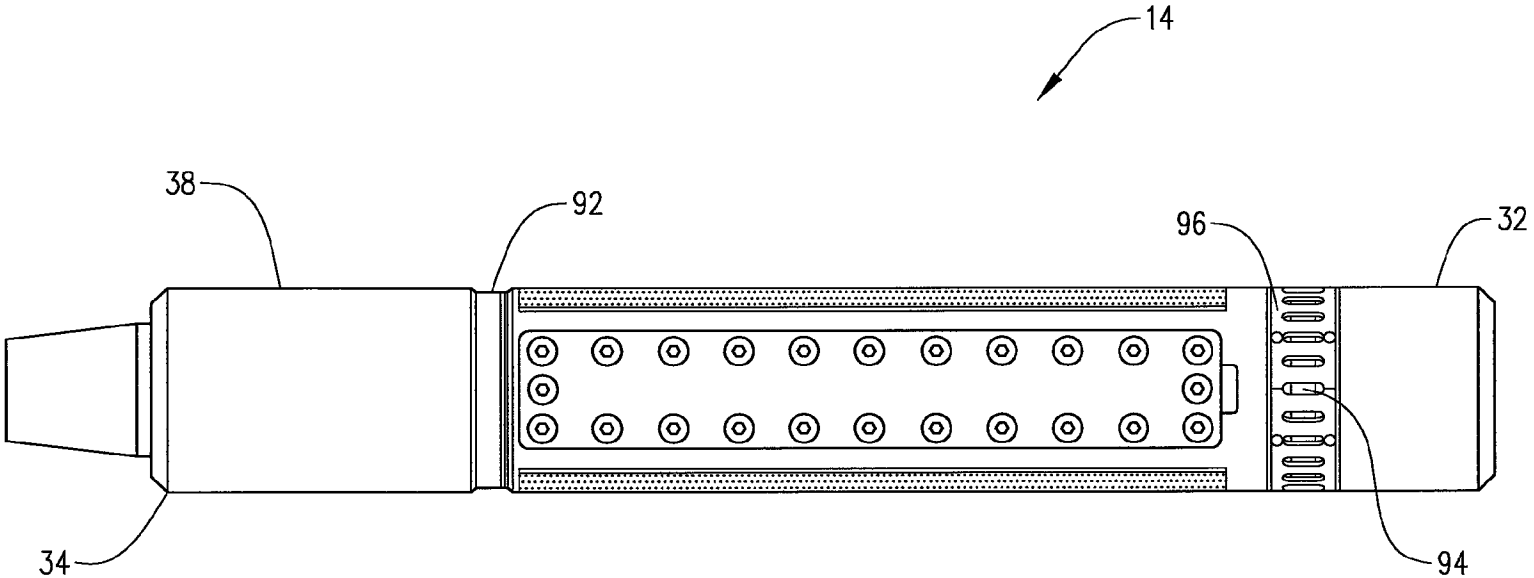

As better illustrated in FIGS. 5A and B, a switch is used so that the electromagnetic signal sent through the surrounding environment (shown as resistors 80) is at a predetermined frequency. Generally, the frequency is chosen so that the signal through the surrounding environment 80, particularly the surrounding drilling fluid, propagates well. The frequencies for the signals generally is below about 1 kHz, and more typically, can be from about 5 Hz to 100 Hz. For some embodiments, the frequencies for the signal can be from about 6 Hz to about 20 Hz but may change depending on the mud or formation. As mentioned above, the signal can be modulated on several different frequencies, which in the example above are four different frequencies. Thus, the signal can be a communication code involving toggling the switch of transmitter 48 at the frequencies 8, 10, 12, and 14 Hz where each frequency corresponds to a different binary symbol. Alternatively, other suitable frequencies can be chosen. The receiver 55 can include a filter so that it eliminates any frequencies below the lowest transmission frequency.

After receiving a transmission or signal from the transmitter 48, the receiver 55 and pulser 54 convert the signal so that a mud pulse representing the sensor data can be used to send the data to the surface. The pulser is used to generate the mud pulse signal in drilling fluid located within the drill string.

It is within the scope of the invention for information to be sent both uphole and downhole rather than merely uphole. For example, information concerning received signal strength from the upper tool-string or receiver 55 can be sent down to transmission sub 14. Thus, if the signal getting through to receiver 55 is too weak, a signal can be sent to transmission sub 14 resulting in the transmission sub increasing the signal strength. Similarly, if the signal received by receiver 55 is too strong, a signal can be sent to transmitting sub 14 resulting in the transmission sub decreasing the signal strength to preserve battery life.

Referring now to FIG. 5C, an embodiment of the transmitter/receiver system that uses a plurality of electrodes on the transmission sub to obtain resistivity measurements is illustrated. FIG. 5C shows a three way bridge circuit, which allows transmission to occur from either downhole end 32 of transmission sub 14 or any of a number of electrodes 82 placed on the body of transmission sub 14. In this way, the current path can be altered and thus resistivity measurements related to slightly different parts of the formation outside transmission sub 14 can be obtained.

The current system allows for communication of data taken at or immediately uphole of the drill bit without a significant increase in the size of the equipment at the bit. The system accomplishes this by using a first electromagnetic signal sent through the drilling fluid and then a second signal transmitted by a second means, such as mud pulses.

Other embodiments will be apparent to those skilled in the art from a consideration of this specification or practice of the embodiments disclosed herein. Thus, the foregoing specification is considered merely exemplary with the true scope thereof being defined by the following claims.

That which is claimed is:

1. A method of transmitting measurement-while-drilling (MWD) data while drilling a wellbore in a subterranean formation, the method comprising the steps of:

forming the wellbore with a drill string ending in a drill bit, said drill string further comprising a transmission sub located uphole of the drill bit, a mud motor located uphole of the data transmission sub and a receiver assembly located uphole of the mud motor and wherein the transmission sub has a first gap at an uphole end of the transmission sub, and the receiver assembly has a second gap;

taking one or more measurements by a sensor contained in the transmission sub; and transmitting the measurements from the transmission sub to the receiver assembly by the transmission sub generating an electromagnetic signal across the first gap and the receiver assembly detecting the signal by measuring voltage across the second gap, and wherein the wellbore has a surrounding environment including drilling fluid and the subterranean formation surrounding the wellbore, and wherein generating the signal across the first gap comprises placing a voltage difference across the first gap, generating a signal having a frequency in the transmission sub, and transmitting the signal through the surrounding environment to a portion of the drill string uphole from the first gap.

2. The method of claim 1, further comprising transmitting the signal from the receiver assembly to the surface by generating a mud pulse.

3. The method of claim 2 wherein the mud pulse is generated in a drilling fluid located within the drill string.

4. The method of claim 1, wherein the portion of the drill string is the mud motor.

5. The method of claim 1, wherein the signal traveling through the surrounding environment is detected by the receiver assembly measuring the voltage across the second gap.

6. The method of claim 5, wherein the drilling fluid is located outside the drill string.

7. The method of claim 1, wherein the signal has a frequency from about 5 Hz to about 1000 Hz.

8. The method of claim 1, wherein sensor is an inclination sensor, a gamma sensor or a resistivity sensor.

9. The method of claim 1, wherein when the transmission sub is on the surface, communication is through the transmission sub without use of a programming port.

10. A method of transmitting measurement-while-drilling (MWD) data while drilling a wellbore in a subterranean formation, the method comprising the steps of:

forming the wellbore with a drill string ending in a drill bit, said drill string further comprising a transmission sub located uphole of the drill bit, a mud motor located uphole of the data transmission sub and a receiver assembly located uphole of the mud motor and wherein the transmission sub has a first gap at an uphole end of the transmission sub, and the receiver assembly has a second gap; and taking one or more measurements by a sensor contained in the transmission sub;

transmitting the measurements from the transmission sub to the receiver assembly by the transmission sub generating an electromagnetic signal across the first gap and the receiver assembly detecting the signal by measuring voltage across the second gap; and transmitting the signal from the receiver assembly to the surface by generating a mud pulse in a first drilling fluid located within the drill string; and wherein the step of generating the signal across the first gap comprises placing a voltage difference across the first gap, generating a signal having a frequency from about 6 Hz to about 20 Hz in the transmission sub, and transmitting the signal to the mud motor through a second drilling fluid located outside the drill string and through the subterranean formation surrounding the drill string; and wherein the signal traveling through the second drilling fluid and subterranean formation is detected by the receiver assembly measuring the voltage across the second gap.

11. A drill-string system for transmitting measurement-while-drilling (MWD) data while drilling a wellbore in a subterranean formation, the drill-string system comprising:

a drill bit;

a transmission sub having a downhole end, an uphole end and a first gap at the uphole end, wherein the transmission sub has a first power source, a sensor and an electromagnetic transmitter, and wherein the transmission sub is located uphole of the drill bit;

a mud motor located uphole of the transmission sub;

a receiver assembly having a downhole end, an uphole end and a second gap, wherein the receiver assembly has an electromagnetic receiver attached across the second gap, and wherein the receiver assembly is located uphole of the mud motor; and a second power source which provides power to the electromagnetic receiver;

wherein the sensor measures at least one parameter of the drilling operation to obtain drilling data, the transmitter sends an electromagnetic signal representing the drilling data to the electromagnetic receiver by the transmission sub generating an electromagnetic signal across the first gap and the electromagnetic receiver detecting the signal by measuring voltage across the second gap.

12. The system of claim 11, wherein the drill-string system further comprises a pulser which is configured to generate a mud pulse such that the electromagnetic signal received by the electromagnetic receiver is converted to a mud pulse signal to transmit the drilling data to the surface.

13. The system of claim 12, wherein the drill-string system further comprises a drill string uphole from the receiver assembly, the drill string having a central bore suitable for conveying drilling fluid downhole and wherein the pulser generates the mud pulse in the drilling fluid within the central bore.

14. The system of claim 11, wherein the transmitter is configured to place a voltage difference across the first gap and to generate a signal having a frequency that is transmitted through a drilling fluid and the subterranean formation to a portion of the drill string uphole from the first gap and downhole from the second gap.

15. The system of claim 14, wherein the drilling fluid is located outside the drill string and surrounds at least the transmission sub and the portion of the drill string extending to the uphole end of the receiver assembly.

16. The system of claim 15, wherein the portion of the drill string is the mud motor.

17. The system of claim 11, wherein the electromagnetic signal has a frequency from about 5 Hz to about 1000 Hz.

18. The system of claim 11, wherein sensor is an inclination sensor, a gamma sensor or a resistivity sensor.

19. A drill-string system for transmitting measurement-while-drilling (MWD) data while drilling a wellbore in a subterranean formation, the drill-string system comprising:

a drill bit;

a transmission sub having a downhole end, an uphole end and a first gap at the uphole end, wherein the transmission sub has a power source, a sensor and an electromagnetic transmitter, and wherein the transmission sub is located uphole of the drill bit and the sensor is an inclination sensor, a gamma sensor or a resistivity sensor;

a mud motor located uphole of the transmission sub;

a receiver assembly having a downhole end, an uphole end and a second gap, wherein the receiver assembly has an electromagnetic receiver located uphole of the second gap, and wherein the receiver assembly is located uphole of the mud motor;

a second power source which provides power to the electromagnetic receiver;

a pulser configured to generate a mud pulse signal; and a drill string uphole from the receiver assembly, the drill string having a central bore suitable for conveying first drilling fluid downhole and wherein the pulser is configured to generate a mud pulse in the drilling fluid within the central bore;

wherein the sensor measures at least one parameter of the drilling operation to obtain drilling data and the transmitter is configured to place a voltage difference across the first gap and to generating a signal having a frequency from 6 Hz to 20 Hz that is transmitted to the mud motor through an environment surrounding at least a portion of the drill-string system, the environment including a second drilling fluid and the subterranean formation, and wherein the transmitter sends drilling data to the surface by generating an electromagnetic signal representing the drilling data across the first gap, which is received by the electromagnetic receiver measuring voltage across the second gap, and the electromagnetic signal is converted to a mud pulse signal to transmit the drilling data to the surface and wherein the second drilling fluid is located outside the drill string and surrounds at least the transmission sub and the portion of the drill string extending to the uphole end of the receiver assembly.

* * * * *